US005596388A

United States Patent [19]

Ohkubo et al.

[11] Patent Number: 5,596,388

[45] Date of Patent: Jan. 21, 1997

[54] PROCESS CARTRIDGE WITH AN INFORMATION FEATURE AND IMAGE FORMING APPARATUS FOR USE WITH THE SAME

[75] Inventors: Masaharu Ohkubo, Yokohama; Mitsuru Honda, Kamagaya, both of Japan

[73] Assignee: Canon Kabushiki Kaisha, Tokyo, Japan

[21] Appl. No.: 536,360

[22] Filed: Sep. 29, 1995

Related U.S. Application Data

[63] Continuation of Ser. No. 155,862, Nov. 23, 1993.

[30] Foreign Application Priority Data

| | | | |
|---|---|---|---|
| Nov. 26, 1992 | [JP] | Japan | 4-337871 |
| Sep. 14, 1993 | [JP] | Japan | 5-228584 |
| Nov. 8, 1993 | [JP] | Japan | 5-278434 |

[51] Int. Cl.[6] ..... G03G 15/00

[52] U.S. Cl. ..... 399/111

[58] Field of Search ..... 355/200, 210, 355/211, 219, 209

[56] References Cited

U.S. PATENT DOCUMENTS

| | | | |
|---|---|---|---|
| 4,917,503 | 4/1990 | Bhattacharjee | 374/102 |
| 5,146,270 | 9/1992 | Matsuo et al. | 355/200 |
| 5,235,384 | 10/1993 | Oka et al. | 355/208 |

FOREIGN PATENT DOCUMENTS

| | | |
|---|---|---|
| 62-124572 | 6/1987 | Japan . |
| 2-219073 | 8/1990 | Japan . |

OTHER PUBLICATIONS

*Patent Abstracts of Japan*, vol. 14, No. 525(P1132) Published Nov. 19, 1990 for Japanese Kokai 02–219073 Published Aug. 31, 1990.

*Primary Examiner*—R. L. Moses

*Attorney, Agent, or Firm*—Fitzpatrick, Cella, Harper & Scinto

[57] ABSTRACT

A process cartridge mountable on a main body of an image forming apparatus comprises a frame, an image bearing member, process means acting on the image bearing member, and a bar code provided on the frame.

34 Claims, 7 Drawing Sheets

FIG. 6

| | | EXISTENCE OF COVER (X LAYER) | EXPERIMENT (1) | EXPERIMENT (2) |
|---|---|---|---|---|
| CRG EXPOSURE PORTION | DATA A | BAR CODE LABEL WITHOUT COVER | BLUE GREEN | VERY LIGHT BLUE GREEN |
| | DATA B | COVER 12μm, ONE LAYER | LIGHT BLUE GREEN | (VERY LIGHT BLUE GREEN ?) |
| | | COVER 12μm, TWO LAYERS | VERY LIGHT BLUE GREEN | NO COLOR ? |
| | | COVER 12μm, THREE LAYERS | (VERY LIGHT BLUE GREEN ?) | NO COLOR ? |
| BODY FLAT PORTION | DATA C | DATA A | VERY LIGHT BLUE GREEN | (VERY LIGHT BLUE GREEN ?) |

FIG. 7

| | COLOR | TENSION STRENGTH |
|---|---|---|
| COLOR GENERATION (STRONG) | (BLUE GREEN) | Ave. 260Kgf/cm$^2$ |
| COLOR GENERATION (MIDDLE) | (LIGHT BLUE GREEN) | Ave. 300Kgf/cm$^2$ |
| COLOR GENERATION (WEAK) | (VERY LIGHT BLUE GREEN) | Ave. 330Kgf/cm$^2$ |
| REFERENCE (NEW ARTICLE) | — | Ave. 380Kgf/cm$^2$ |

PROCESS CARTRIDGE WITH AN INFORMATION FEATURE AND IMAGE FORMING APPARATUS FOR USE WITH THE SAME

This application is a continuation of application Ser. No. 08/155,862 filed Nov. 23, 1993.

BACKGROUND OF THE INVENTION

1. Field of the Invention

The present invention relates to a process cartridge and an image forming apparatus on which said process cartridge can be mounted. Herein, the image forming apparatus may be, for example, an electrophotographic copying machine, a word processor, a facsimile apparatus, a laser beam printer or an LED printer.

2. Related Background Art

The image forming apparatuses, such as a printer, perform the recording of an image in such a manner as to form a latent image on an image bearing member uniformly charged by selective exposure, develop this latent image with toner, and transfer the toner image onto the recording medium. With such apparatuses, the maintenance of units is not permitted except by the expert serviceman, causing an inconvenience for the user. Thus, an image forming apparatus has been put to practical use in which the image bearing member, electrifier, developing unit, and cleaning unit are integrated into a unit structure as a cartridge, so that the refilling of toner or the replacement of image bearing member components reaching the end of their life is enabled by the user mounting the cartridge on the apparatus itself to facilitate the maintenance.

Such process cartridge has a main component imprinted or marked by permanent ink with a lot number. Also, when the permanent ink is used, it is marked on the sheet metal portion, such as a cleaning blade. This imprinting or permanent ink is provided to reveal the manufacturing time or a manufacturer of components used in the cartridge, when such components causes a trouble.

However, the process cartridge with the above constitution had the following problems. The imprinting of components used in the process cartridge may be difficult, although it can be made, if the outer package is made of thermoplastic. Also, with the imprinting method, only a small amount of information can be written. On the other hand, when permanent ink is used to write information, there is a wide scope of selection for recording materials, but the information often disappears due to friction with any other objects.

Also, with the process cartridge mentioned above, the components are increasingly subjected to reuse or recycling for the purposes of resource saving, energy saving and reduction of contaminants, owing to the recent increased concern for environmental protection. For example, in the process cartridge, the components for rollers such as a charging roller, a developing sleeve, a transfer roller, a fixing roller, a cleaning roller, or a conveying roller, have a longer life span, and are usable even after the use of toner within the cartridge. Therefore, in recent years, cartridges remaining after the depletion of toner tend to be reused or recycled as components for the rollers mentioned above.

Thus, in recycling it is preferable to assess the extend to which the the component has been used, that is, to what extent the component has deteriorated, including the influence of its service environment, and to determine whether the component is reusable, or should be destroyed or otherwise reused in any other form (e.g., a resin component made of pellets, and mixed into virgin material to provide moldings).

Herein, it is typical to indicate a lot number in the main components of the process cartridge, which reveals the production time of cartridge. However, because the life of cartridge components is affected by the service environment, the production time and component life are not necessarily consistent. Accordingly, in recycling the process cartridge, it is necessary to examine precisely whether individual components are reusable or not after decomposition and cleaning, which often took a large amount of time and money.

SUMMARY OF THE INVENTION

An object of the present invention is to provide a process cartridge provided with information indication, and an image forming apparatus.

It is another object of the present invention to provide a process cartridge provided with fadeless indication of information, and an image forming apparatus.

It is a further object of the invention to provide a process cartridge provided with information indication capable of containing more information, and an image forming apparatus.

It is a still further object of the invention to provide a process cartridge provided with a bar code, and an image forming apparatus.

It is another object of the present invention to provide a process cartridge which makes the remaining extent of life distinguishable in accordance with the service environment, and an image forming apparatus.

BRIEF DESCRIPTION OF THE DRAWINGS

FIG. 6 is a table showing the results of experiments 1 and 2; and

FIG. 7 is a table showing the results of experiment 3.

DETAILED DESCRIPTION OF THE PREFERRED EMBODIMENTS

Figure 1:
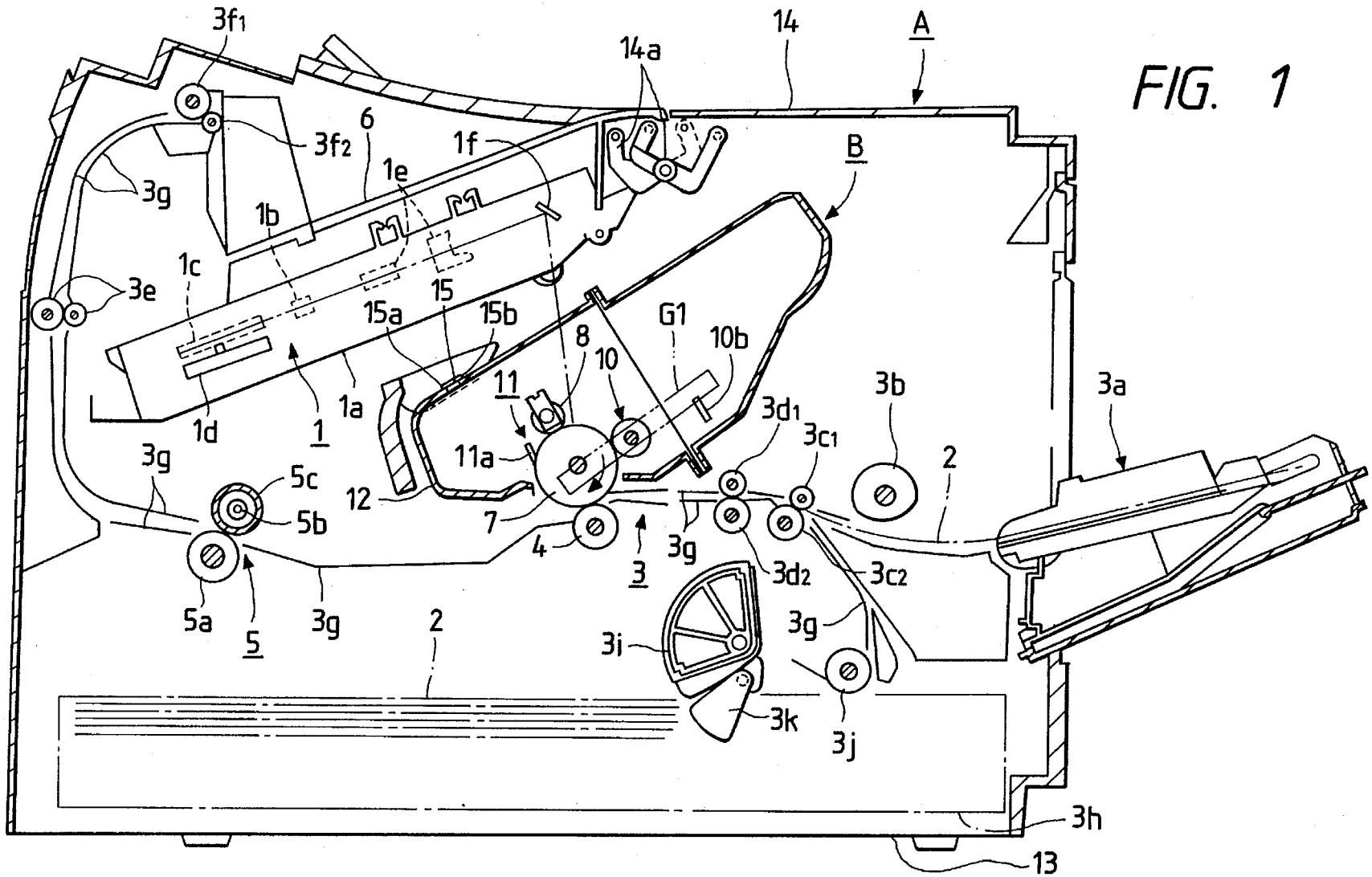
FIG. 1 is a side cross-sectional view of an image forming apparatus with a process cartridge mounted thereon according to an embodiment of the present invention.

A process cartridge and an image forming apparatus according to the first embodiment of the present invention will be specifically described below with reference to the drawings. The overall schematic constitution of the image forming apparatus with the process cartridge mounted will be described first. FIG. 1 is a cross-sectional view of a laser printer which is one form of the image forming apparatus, and FIG. 2 is a cross-sectional constitutional explanation view of the process cartridge.

This image forming apparatus A forms a developer image (hereinafter called "toner") onto a photosensitive drum, which is an example of an image bearing member, by directing radiation of an optical image based on image information from an optical system 1, as shown in FIG. 1. A recording medium 2 is conveyed by conveyance means 3, synchronously with the formation of toner image, and the toner image formed on the photosensitive drum is transferred onto the recording medium 2 by transferring means 4 in an image forming unit which is made as a process cartridge B. Thereafter, the recording medium 2 is conveyed to fixing means 5 to fix the transferred toner image, and exhausted into an exhausting unit 6.

Figure 2:
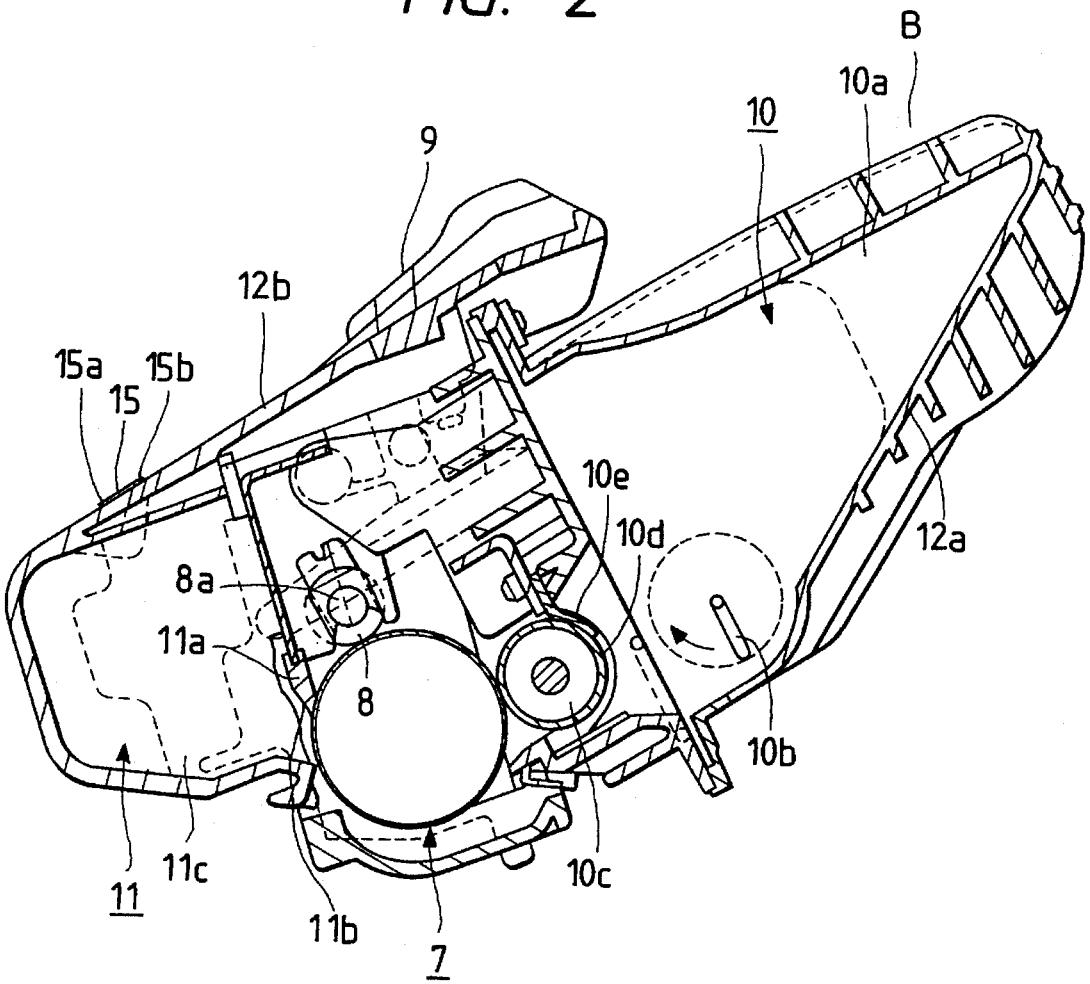
FIG. 2 is a side cross-sectional view of a process cartridge according to an embodiment of the present invention.

In the process cartridge B constituting the image forming unit, the photosensitive drum 7 is rotated to electrify its surface uniformly with charging means, as shown in FIG. 2. On the other hand, an optical image from the optical system 1 is exposed via an exposure unit 9 onto the photosensitive drum 7 to form a latent image, and thereby form a toner image corresponding to the latent image in developing means 10. After the toner image is transferred onto the recording medium 2 by the transferring means 4, the toner remaining on the photosensitive drum 7 is removed by cleaning means 11. Note that each component, such as photosensitive drum 7, is accommodated within a frame body 12 forming a housing to make a cartridge.

The constitution of each unit of the image forming apparatus A and the process cartridge B will be now described.

[Image forming apparatus]

First, the image forming apparatus A will be described regarding the constitution of each unit of optical system, convey means, transfer means, fixing means, and cartridge mounting means, in this order.

(Optical system)

Optical system 1 applies an optical image onto the photosensitive drum 7 by light illumination based on image information read from external equipment. As shown in FIG. 1, within an optical unit 1*a* provided on a main body 13 of the apparatus are accommodated a laser diode 1*b*, a polygon mirror 1*c*, a scanner motor 1*d*, an image forming lens 1*e*, and a reflection mirror 1*f*.

If an image signal from the external equipment, such as a computer or a word processor, is supplied, the laser diode 1*b* emits light in accordance with the image signal to be directed as an image light to the polygon mirror 1*c*. This polygon mirror 1*c* is rotated at high speed by the scanner motor 1*d*, and the image light reflected from the polygon mirror 1*c* is directed via the image forming lens 1*e* and the reflection mirror 1*f* onto the photosensitive drum 7 which is rotating, so that the surface of the drum is selectively exposed to form a latent image thereon in accordance with the image information.

(Recording medium convey means)

The constitution of convey means 3 for conveying the recording medium 2 (e.g., a recording sheet, an OHP sheet, a cloth or a thin plate) will be next described. This embodiment allows two modes of feeding the recording medium 2; manual insertion and cassette feed. The constitution for enabling manual insertion is to set one or more recording media 2 on a sheet feed tray 3*a* to start the image formation, as shown in FIG. 1. A recording medium 2 on the sheet feed tray 3*a* is fed into the apparatus by a pick-up roller 3*b*. If a plurality of recording media 2 are set, they are separated by separation rollers 3*c*1, 3*c*2 to feed each one sheet, which is then conveyed so that the leading edge of recording medium 2 may abut against a pair of resist rollers 3*d*1, 3*d*2. The pair of resist rollers 3*d*1, 3*d*2 are driven in rotation in accordance with the image forming operation to convey the recording medium 2 to the image forming unit. Further, the recording medium 2 after the image formation is conveyed to the fixing means 5, and exhausted to the exhaust unit 6 by the action of an intermediate exhaust roller 3*e* and a pair of exhaust rollers 3*f*1, 3*f*2. Between the rollers is provided a guide member 3*g* for guiding the conveyance of the recording medium 2. Also, the sheet feed tray 3*a* constitutes the outer package of the apparatus 13, when not in use.

On the other hand, the constitution for the cassette feeding comprises a mounting portion of a cassette 3*h* on the inner bottom of the apparatus 13, as shown in FIG. 1, and if a print button (not shown) is turned on, the recording medium 2 within the cassette 3*h* mounted on the mounting unit is conveyed one sheet from the upper side to the pair of resist rollers 3*d*1, 3*d*2 by the action of pick-up roller 3*i* and sheet feed roller 3*j*. The members following the pair of resist rollers 3*d*1, 3*d*2 are identical to those of the manual insertion. Note that 3*k* is a sensor for detecting the recording medium 2 within the cassette 3*h*.

(Transfer means)

Transfer means 4 transfers a toner image formed on the photosensitive drum 7 in the image forming unit onto the recording medium 2, and consists of a transfer roller 4, as shown in FIG. 1. That is, with the recording sheet 2 pressed against the photosensitive drum 7 of process cartridge B mounted therein, the transfer roller 4 transfers the toner image on the photosensitive drum 7 onto the recording medium by applying a voltage reverse in polarity to that of the toner image formed on the photosensitive drum 7 to the transfer drum 4.

(Fixing means)

Fixing means 5 fixes the toner image which has been transferred onto the recording medium 2 by the application of the voltage to the transfer roller 4, and consists of a drive roller 5*a* for drive rotation, a heater 5*b* provided inside thereof, and a fixing roller 5*c* driven in rotation by close contact with the drive roller 5*a*. That is, when the recording medium 2 having the toner image transferred thereonto in the image forming unit passes between the drive roller 5*a* and the fixing roller 5*c*, it is subjected to a pressure caused by a pressing force of both rollers 5*a*, 5*c*, and to a heat produced by the fixing roller 5*c*, so that the toner on the recording medium 2 is fixed on the recording medium 2.

(Process cartridge mounting means)

The image forming apparatus A is provided inside with cartridge mounting means for mounting a process cartridge B. The mounting of the process cartridge B on the apparatus 13 is enabled by opening a front cover 14. That is, on the upper side of the apparatus 13 is provided the front cover 14 which can be opened or closed by the action of a hinge 14*a*. By opening the front cover 14, a cartridge mount space will be seen to be provided within the apparatus 13, with the left and right guide members G1 (only one shown) attached on the left and right wall faces within the main body. The left and right guide members G1 each are provided with a guide for the insertion of the process cartridge B, with which the process cartridge B can be mounted on the image forming apparatus A in such a manner as to insert the process cartridge B along the guide and close the front cover 14.

[Process cartridge]

Process cartridge B to be mounted on the image forming apparatus A will be described regarding the constitution of each unit.

This process cartridge B has an image bearing member and at least one process means. Herein, the process means consists of, for example, charging means for charging the surface of the image bearing member, developing means for developing a toner image on the image bearing member, and cleaning means for cleaning the remaining toner on the surface of the image bearing member. The process cartridge B in this embodiment has charging means 8, exposure unit 9, developing means 10, and cleaning means 11 which are disposed around the circumference of the electrophotographic photosensitive drum 7 as an image bearing member, all of which are enclosed to form a unit by a housing consisting of a frame body 12 including a first frame body 12*a* and a second frame body 12*b*, as shown in FIG. 2, so that the process cartridge is detachable from the apparatus itself 13.

Next, the process cartridge B will be described regarding the constitution of each unit of photosensitive drum 7, charging means 8, exposure means 9, developing means 10 and cleaning means 11 in this order.

(Photosensitive drum)

Photosensitive drum 7 according to this embodiment is constituted by applying an organic photosensitive layer over the external peripheral surface of a cylindrical drum substrate made of aluminum. This photosensitive drum 7 is rotatably mounted on the frame body 12, so that the photosensitive drum 7 is rotated in a direction of the arrow as indicated in FIG. 1 with the image forming operation by a drive force of a drive motor provided in the apparatus main body which is transmitted to a gear (not shown) secured to one end longitudinally of the drum 7.

(Charging means)

Charging means charges the surface of the photosensitive drum 7 uniformly using a so-called contact electrification in this embodiment in which an charging roller 8 is rotatably mounted on the frame body 12. The charging roller 8 consists of a conductive resilient layer provided on a roller shaft 8*a* made of metal, a highly resistive resilient layer thereon, and further a protective layer on the upper surface. The conductive resilient layer is made by dispersing carbon on a resilient rubber layer such as EPDM or NBR, acting to conduct a bias voltage to be supplied to the roller shaft 8*a*. Also, the highly resistive resilient layer is made of urethane rubber and contains a minute amount of conductive fine powders, for example, whereby when the charging roller is located opposite a portion having a high conductivity such a pin hole on the photosensitive drum 7, it serves to prevent any rapid drop of bias voltage by limiting the leak current into the photosensitive drum 7. The protective layer is made of N-methyl methoxide nylon, and acts to prevent plastic substances of conductive resilient layer or highly resistive resilient layer from making contact with the photosensitive drum 7 to change in quality the surface of the photosensitive drum 7.

The charging roller 8 is placed into contact with the photosensitive drum 7, and in forming an image, the charging roller 8 is driven in rotation by the rotation of photosensitive drum 7, while the surface of the photosensitive drum 7 is uniformly electrified by the application of a DC voltage and an AC voltage in superimposition to the charging roller 8.

(Exposure unit)

Exposure unit 9 exposes an optical image directed from the optical system 1 onto the surface of the photosensitive drum 7 which has been uniformly charged by the charging roller 8 so as to form an electrostatic latent image on the surface of the drum 7, and consists of an opening 9 for conducting the optical image onto the upper face of cartridge frame body 12.

(Developing means)

Developing means 10 has a toner reservoir 10*a* for storing the toner, and within the toner reservoir 10*a*, a toner feeding member 10*b* rotating in a direction of the arrow to feed the toner, as shown in FIG. 2. Further, it is provided with a magnet 10*c* inside thereof, and a developing sleeve 10*d* for forming a thin toner layer on the surface by the rotation which is spaced with a slight gap away from the photosensitive drum 7.

When the toner layer is formed on the surface of the developing sleeve 10*d*, an amount of frictionally charged sufficient to develop the electrostatic latent image on the photosensitive drum 7 is obtained owing to the friction between the toner and the developing sleeve 10*d*. Also, a developing blade 10*e* is provided to regulate the layer thickness of the toner.

(Cleaning means)

Cleaning means 11 is comprised of a cleaning blade 11*a* for cleaning off the toner remaining on the drum 7 by making contact with the surface of the photosensitive drum 7, a scoop sheet 11*b* located below the blade 11*a* to scoop the toner cleaned off and in slight contact with the surface of the photosensitive drum 7, and a waste toner reservoir 11*c* for reserving the waste toner cleaned off.

Note that 20 is a handle, and 21 is a guide, which engages guide G1 on the main device side upon mounting on the main device.

(Bar code)

Figure 3:
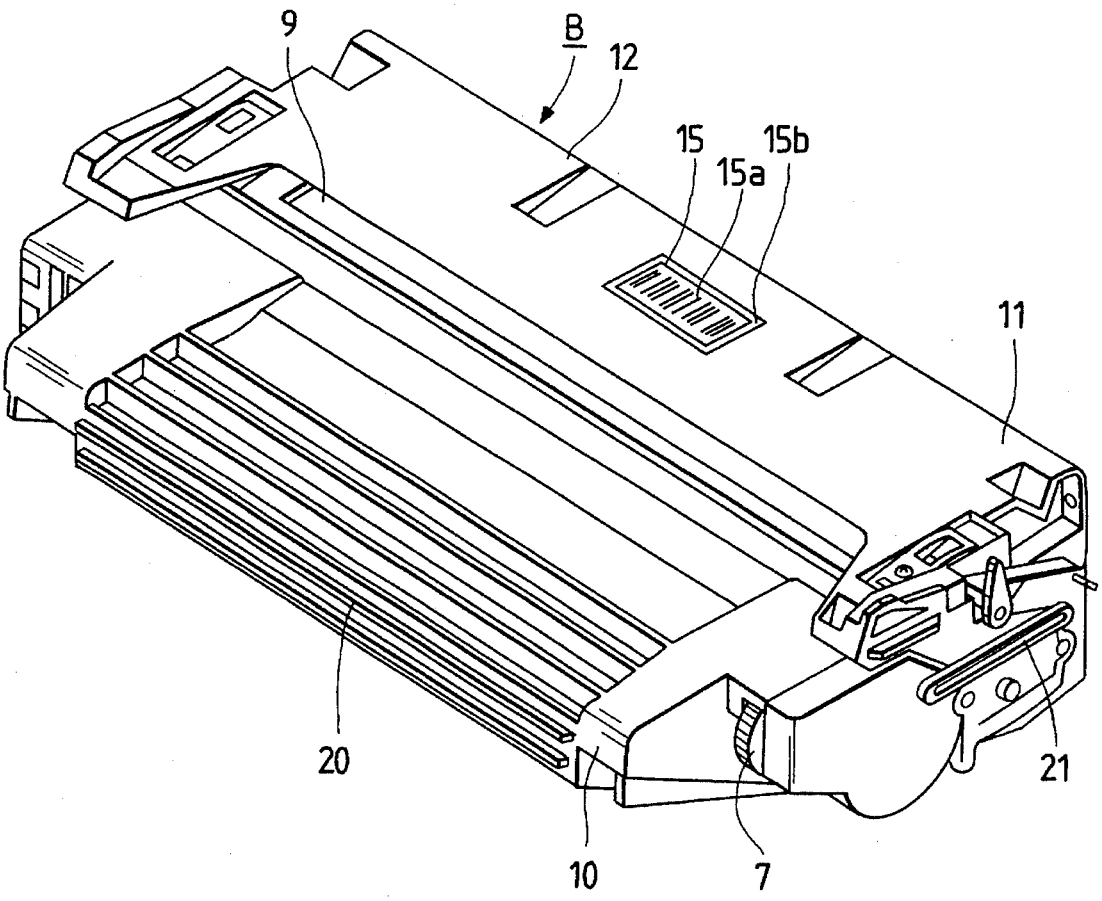
FIG. 3 is an external perspective view of a process cartridge according to an embodiment of the present invention.

An information sheet 15 having information marked with a bar code 15*a* is affixed on the surface of the frame body 12 of the process cartridge B, as shown in FIG. 3. This information sheet 15 has information concerning the main components such as photosensitive drum 7, electrifying roller 8, and cleaning blade 11*a* of cleaning means. For example, a place of production, a producer, a production time and a manufacturing lot number. Accordingly, the history of main components can be readily known by reading the bar code 15*a* through a reader (not shown), so that for example, the process cartridge B redeemed from the market after use can be quickly dealt with.

In recent years, the used cartridge B has been redeemed and recycled with the goal of protecting the earth's environment. Next, the procedure of recycling the process cartridge B will be described.

The procedure of recycling the process cartridge B roughly includes (1) redemption, (2) classification, (3) disassembly, (4) selection, (5) cleaning, (6) examination, and (7) reassembly, which will be specifically described in the following.

(1) Redemption

Used process cartridges B are collected into a recovery center in cooperation of users and service men.

(2) Classification

Used process cartridges B thus collected into the recovery center at each site are transported to a cartridge recycle factory. And used process cartridges B are classified according to each type.

(3) Disassembly

Process cartridges B thus classified are disassembled and broken down into components.

(4) Selection

Each component is subjected to a selection between recyclable component and unrecyclable component due to reaching the end of life or being damaged.

(5) Cleaning

Components passing selection are cleaned and made recyclable as the components of new cartridge B.

(6) Examination

Components passing selection and cleaning are examined to see whether their sufficient functions have been recovered to be recyclable.

(7) Reassembly

New process cartridges are assembled using components passing examination with the toner refilled in the toner container.

During recycling, the history of main components can be instantly discriminated by reading the bar code information provided on the cartridge. That is, it is possible to make a discrimination whether components are recyclable or not from the written 10 information as to how many times the components were recycled in the past.

The recording of the bar code 15*a* is easy to make using the thermal recording method, but it is necessary to select the location at which to affix the information sheet 15 having the bar code 15*a* that is not exposed to high temperatures. Therefore, it is preferable that the information sheet 15 may be placed on the outer surface of the cartridge frame body 12 in the neighborhood of the developing means 10 which is subjected to relatively less temperature elevation in the cartridge B. Also, it is known that if the toner drops on and contaminates the bar code information, the information may be erroneously read. Therefore, it is preferable to paste an organic-proof transparent seal 15*b* to cover the upper face of the information sheet.

Another embodiment of the present invention will be described below with reference to FIGS. 4 to 7.

This embodiment allows the duration of life to be identified in accordance with the service environment.

Figure 4:
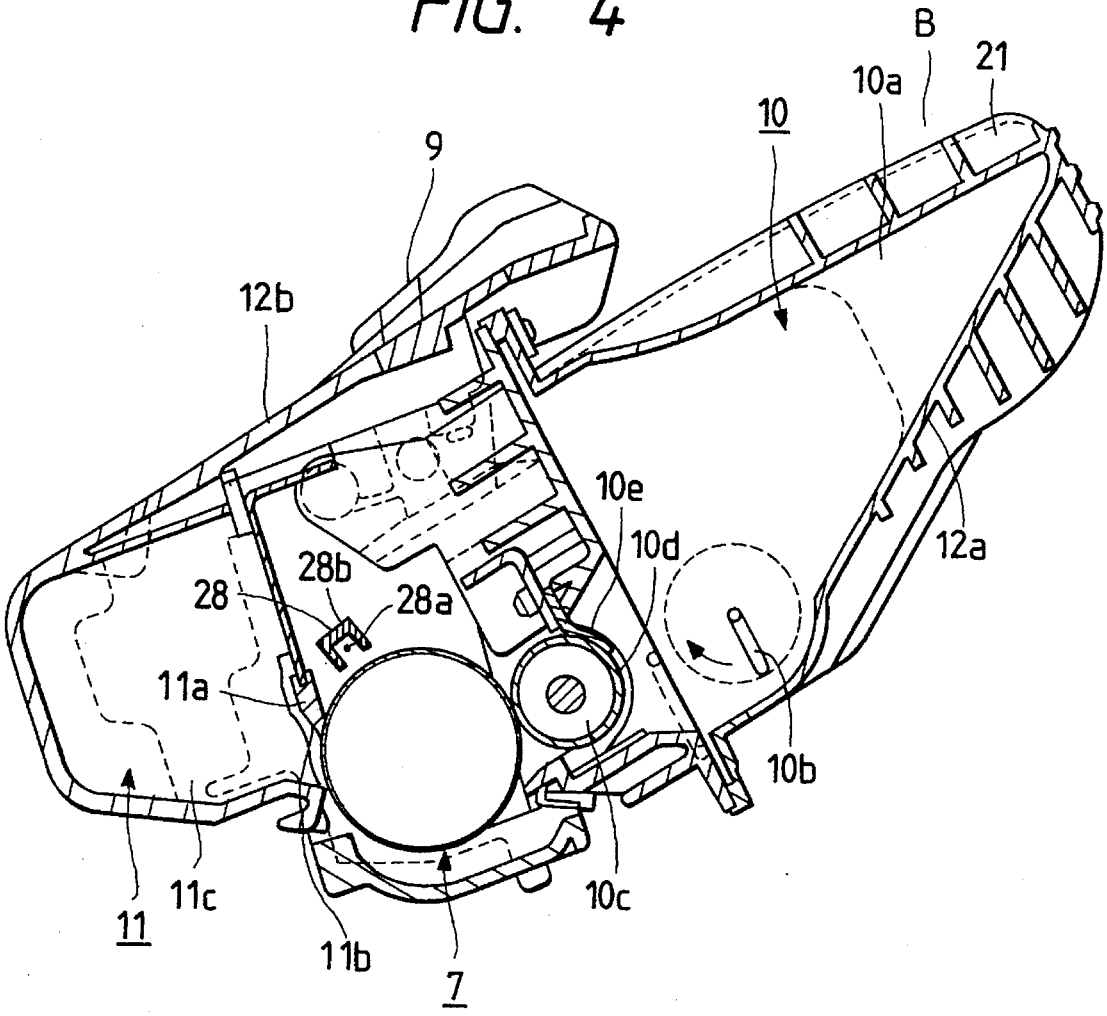
FIG. 4 is a side cross-sectional view of a process cartridge according to another embodiment of the present invention.

In this embodiment, the same reference numerals are attached to the same components as used in the previous embodiment, the explanation of which is also referred to. Herein, it is to be noted that this embodiment uses a corona discharge device 28, instead of a charging roller, as charging means in the process cartridge B, as shown in FIG. 4. In the Figure, 28*a* is a corona wire and 28*b* is a shield plate.

Figure 5:
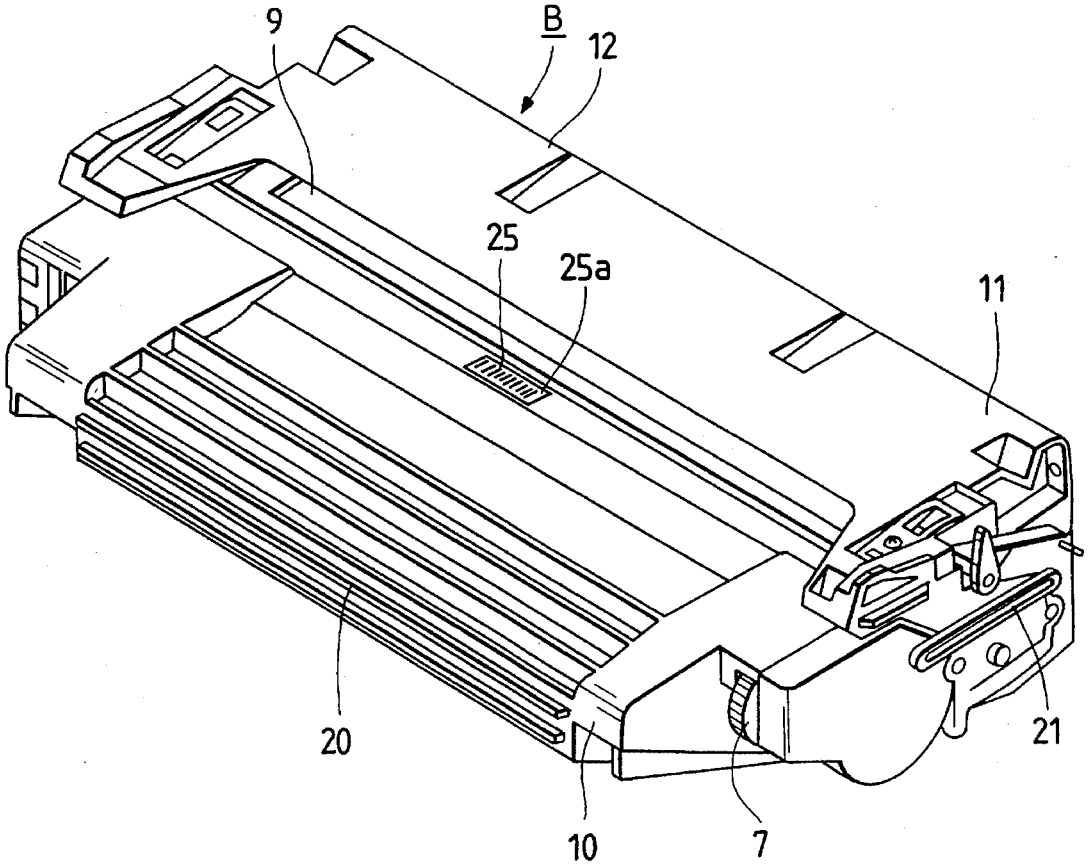
FIG. 5 is an external perspective view of a process cartridge as shown in FIG. 4.

On the surface of a frame body 12 of a process cartridge B according to this embodiment, an indicator 25 indicating the degrading state of process cartridge B is provided as shown in FIG. 5. This indicator 25 consists of a bar code label 25*a* having written information affixed thereon, this label 25*a* having leuco base applied thereon. Colorless leuco base becomes carbinol base by oxidation, and further produces colored salts of carbonium ion by the addition of acids. Specifically, leuco base is applied over the surface (e.g., the entire surface) of the label 25*a* having a bar code written with the ink, as described earlier. Or leuco base may be applied on a part (e.g., a part without bar code) of the label 25*a*. It is needless to say that the color of leuco base used (when colored with dye) and the color of bar code ink are made different.

A process cartridge B is mounted on the image forming apparatus A to form an image. Only a very small amount of ozone is produced from charging means 28 (corona discharge device). With the reaction of ozone or oxidant and acid substance in nitrogen oxides, as well as water contents in the atmosphere, leuco base is colored. That is, leuco base is oxidized by ozone and converted into carbinol base, and further into carbonium ions due to the influence of water contents and nitrogen oxides, gradually colored.

The occurrence of ozone may be different depending on the service condition or service environment of the image forming apparatus, and the degrading rate of the photosensitive drum 7 varies with the yield of ozone. Accordingly, the coloring state of leuco base varies with the degrading state of components, whereby the degrading state of components can be discriminated from the coloring state of the indicator 25.

To match the coloring of the indicator 25 with the degrading state of components, it is preferable to locate the indicator 25 at a site through which ozone or nitrogen oxides will pass in forming the image. For example, it is provided in the vicinity of an exposure opening 9 of process cartridge B, as shown in FIG. 5. This is because the exposure path is located near the charging means 28, and ozone produced in the charging means 28 is exhausted mostly through the expo sure opening 9.

Examples of leuco base preferably used in this embodiment may include Malachite Green, Spirit Blue, Methyl Violet B and Methyl Violet 5B.

Furthermore, pressure sensitive and heat sensitive colorant is also referred to as a leuco color or a color former, which is the general term for the compounds of dye precursor. These are colorless compounds having the property of coloring with acids, alkalis, oxidation, light, or pressure. Among them, this embodiment uses the components of coloring with oxidation or acids (i.e., in combination with leuco base conventionally used). Accordingly, in addition to triphenylmethane type leuco base described earlier, a wider range of structures can be employed.

Such structures can be classified into several types, but the basic variation resides in coloring due to ionization caused by oxidation and/or existence of acids. Inter alia, a remarkable change of structure is found in such an instance that a group including N (amino group) in the original structure is ionized positively by acids, and cyclized to C in the central methane structure to cause cleavage of carboxyl group (of a structure without H; —C—C=O) to produce carboxyl group.

Besides triphenylmethane type as mentioned above, the structures may also include triphenylmethanephthalide type compounds, such as crystal violet lactone (CVL), indolylphthalide type compounds, fluoran type compounds (black type), and pyridine blue. Additionally, several structures are known which are colored in red, orange or dark green depending on the kind of functional group or the way of bonding thereof.

Also, triarylmethane type compounds are usable which resemble the central skeleton of triphenylmethane type compounds as mentioned above.

Further, regarding the structural change of these compounds upon manifestation of the coloring function, besides those described above, a dye precursor is considered to be also a compound adaptable to the purpose of this embodiment, if the structure cyclized to carbon atom in the central methane of triphenyl type (and similar structure) is cleaved by acids. For example, a dye precursor (leuco base) of rhodamine lactam type which has —N—C=O, instead of —C—C=O, is also usable, as in the above embodiment.

Herein, when malachite green is used, for example,

| | |
|---|---|
| Dimethyl-aniline | 50 g |
| Benzaldehyde | 20 g |
| Anhydrous zinc chloride | 40 g |

are mixed and heated in an evaporating dish for about four hours. After reaction, it is transferred to a flask, subjected to steam distillation vigorously and continued until the odor of dimethyl-aniline disappears. After cooling, zinc chloride is removed by separating water from a blue green compound, which is recrystallized with absolute alcohol, so that almost colorless leuco base is crystallized. Leuco base thus obtained is applied onto the indicator 25.

When the degradation monitor period with the indicator 25 having leuco base applied extends over the long term, it is preferable to provide a protective layer on the upper layer of the indicator 25 so that the indicator 25 may not be worn out by the friction with other objects. This protective layer is necessary to be selected in respect of the material or thickness in consideration of the permeation of gases such as ozone or nitrogen oxides, and preferably may be made of ethylene-acetic acid vinyl copolymer saponified substance (EVOH), polyvinyl alcohol (PVA), acrylonitrile (AN), polyvinylidene chloride (PVDC), nylon, polyethylene terephthalate (PET). Its thickness is preferably approximately from 12 μm to 50 μm.

Typically, in the ethylene-type polymer, for example, if the substitutional group has polarity, dipoles are mutually formed, which causes less movement and thus aggregation, so that gases are difficult to permeate. Also, because the permeability is related to the product of solubility coefficient and diffusion coefficient of gas, it is necessary to note the relation of the solubility coefficient of object gas to that of film polymer.

Also, the protective layer may be provided by forming a film directly on the indicator 25, or affixing a protective film on the indicator 25. Then, if the thickness of protective layer covering the indicator 25 is different in sections and is changed at stages, the permeation state of ozone may be different with the thickness of the protective layer, so that leuco base applied on the indicator 25 is colored at stages. Accordingly, it is possible to discriminate the degradation at smaller and more precise.

Also, the heat sensitive and pressure sensitive dye can fulfill its essential purpose through a color reaction with the addition of an acid developer. Developer is classified into three types of clay, resin and organic carboxylic acid type metallic salt.

When used for the purposes as in this embodiment, the use of such developer may be desirable if the degree of coloration of dye precursor (leuco base) above exemplified with acid substances produced by the electrophotographic image forming apparatus is made substantially equal to the degree of degradation of apparatus under the service environment. Further, in this case, it is effective to provide means for capsulizing the developer.

Because the duration of service extends over the long term, the use of heat sensitive and pressure sensitive agent is combined with an intensifier and preservatives (e.g., a hydrophobic agent, an oil resistant agent, a light resistant agent, a texture antifoggant). Accordingly, it can be also used in this embodiment.

While in this embodiment the indicator 25 is provided by affixing the label having leuco base applied thereon, it will be appreciated that this indicator 25 may be provided directly on the frame body by applying leuco base directly onto the frame body of the process cartridge B.

Although the indicator 25 can be simply provided by applying leuco base thereon, the indicator 25 may be provided by pasting a label having information with a bar code, to which leuco base is applied, as shown in FIG. 5. The information is concerned with the main components such as a photosensitive drum 7, a corona discharging device 28, and a cleaning blade 11*a* in cleaning means, and includes, for example, a place of production or a producer, or a production time, or a manufacturing lot number.

As described above, information (with the same content as the previous embodiment) is written with the bar code in the indicator 25 and read by a bar code reader, thereby the history of process cartridge or main components thereof can be readily known. For example, for the redeemed process cartridge B, it is possible to know the production time and place, in addition to the degrading state of components based on coloration of leuco base, thereby facilitating the recycling treatment of the process cartridge.

In recycling the process cartridge as described above, the degrading state of components can be readily determined in accordance with the service environment by checking the coloring state of the indicator, resulting in better recycling efficiency.

Note that the indicator 25 may be provided, besides, on the surface of the frame body 12, for example, on the photosensitive drum 7 or the corona discharging device 28, or on each unit or component such as the developing unit or cleaning blade 11*a*, with leuco bases applied to the indicator 25, so that it is possible to determine the degrading state in detail for each component.

[Experiment results]

To follow are the results of an image forming experiment providing a label with leuco base applied thereto.

(Data A)

| | |
|---|---|
| Malachite green leuco base | 10 parts |
| Lead oxide ($PbO_2$) | 7 parts |
| Zinc chloride ($ZnCl_2$) | 8 parts |
| Phenol resin | 100 parts |

were mixed in methanol to make a paint. It was applied as a pattern like a bar code onto a label paper by means of a slender brush and dried by heating. This label paper was cut in size of 10 mm×20 mm, and affixed near the exposure portion 9 of the process cartridge B, which was made data A.

(Data B)

A 12 μm-thick polyethylene-terephthalate (PET) film was covered on the surface of the label used with the data A to provide a protective layer. A label with one, two and three protective layers was formed and affixed near the exposure portion 9 of the process cartridge B, like data A, which was made data B.

(Data C)

A label used in the data A was affixed to the flat portion of the image forming apparatus main body near the exposure portion of process cartridge, which was made data C.

(Experiment 1)

Using process cartridges from data A, B and C and the image forming apparatus under high temperature and high humidity (temperature 40° C., humidity 95%) condition, which was believed to be severest under the supposed service environment, a durability test was conducted up to a limit number of sheets usable for the process cartridge. Each process cartridge subjected to the durability test was contained in an open bag, and stored under the same environment for one month corresponding to the redemption and transportation period, whereafter the coloring state of the indicator was assessed.

(Experiment 2)

Using process cartridges of data A, B and C and the image forming apparatus under office environment (temperature 23°±2° C., humidity 50±10%) as the service environment, a durability test was conducted up to a limited number of sheets usable for the process cartridge. The process cartridge was stored under the same office environment for one month as in the experiment 1, whereafter the coloring state of the indicator was assessed.

(Experiment 3)

A label having a large difference in the degree of coloration from data A to data C in the experiment 1 was selected, the tension strength was measured under the office environment, particularly for the cleaning member which was ascertained with the influence of ozone among the components used in the process cartridge, whereby the degree of coloration for the indicator and the tension strength were compared.

(Results of experiment 1)

For the protective layer in data A and data B consisting of one layer, it was observed that the indicator turned blue green due to the coloration of leuco base, but for the protective layer consisting of two and three layers, the coloration was not fully observed. Also, in the data C, slight coloration was observed similar to that of the protective layer consisting of one layer in the data B. Its results are listed in Table of FIG. 6.

(Results of experiment 2)

From the results of the degree of coloration as listed in Table of FIG. 6, it will be found that in the experiment under temperature and humidity condition suitable for the office environment, there was no data which exhibited significant coloration in the scope of durability test in this embodiment. This suggests that despite the production of ozone and acid substances due to durability, its influence may be appreciably suppressed in this environment.

(Results of experiment 3)

Between the degree of coloration on the indicator and the tension strength of component was found a correlation as shown in Table of FIG. 7. That is, the cleaning member become s weak with the progress of degradation. Accordingly, by seeing the degree of coloration on the indicator which is in correlation with it, the life of component could be estimated.

Note that the durability of the image forming apparatus may be different with the components of each unit, but when the degree of degradation is estimated by providing an indicator on each component, it is desirable to set the constituents of leuco base so that the durability of component and the oxidation or ionization rate of leuco base applied to the indicator are consistent. Note that leuco base is of a light color even upon coloration, causing no trouble for a reader to read the bar code.

[Other embodiments]

It should be noted that the process cartridge B according to the present invention as previously described is suitably applicable not only to forming a monochrome image, but also to forming a multi-color image (e.g., bicolor or tricolor image or full-color image) by providing a plurality of developing means.

Various developing methods can be also used, including well-known two-constituent magnetic brush developing method, cascade developing method, touch-down developing method and cloud developing method.

While charging means employed a so-called contact charging method in the first embodiment as previously described, it is of course possible that another conventionally used constitution can be also adopted in which a metallic shield made of aluminum is provided on the three sides around a tungsten wire, and positive or negative ions produced by applying a high voltage to the tungsten wire are moved to the surface of photosensitive drum to electrify uniformly the surface of the drum.

Note that besides the roller type described earlier, the charging means may be of a blade type (charging blade), a pad type, a block type, a rod type or a wire type.

Also, the cleaning method of remaining toner on the photosensitive drum may be implemented as well by constituting cleaning means using a blade, a fur brush or a magnetic brush.

The process cartridge as described above has an electrophotographic photosensitive drum, for example, as image bearing member and at least one process means. Accordingly, the forms of process cartridge may include, besides those of the previous embodiments, a form in which image bearing member and charging means are integrated as a cartridge to be detachable from the main device, a form in which image bearing member and developing means are integrated as a cartridge to be detachable from the main device, a form in which image bearing member and cleaning means are integrated as a cartridge to be detachable from the main device, and a form in which image bearing member and a combination of two or more process means above cited are integrated as a cartridge to be detachable from the main device.

That is, the process cartridge described above is formed as a cartridge in which charging means, developing means or cleaning means, and electrophotographic photosensitive body are integrated, this cartridge being made detachable from the image forming apparatus itself. Also, it may be formed as a cartridge in which at least one of charging means, developing means and cleaning means, and the electrophotographic photosensitive body are integrated, detachably from the image forming apparatus. Further, it may be formed as a cartridge in which at least the developing means and the electrophotographic photosensitive body are integrated to be detachable from the main device.

While the previous embodiment was described with an image forming apparatus in which the photosensitive drum 7 or the developing sleeve 10*d* is made a cartridge and an image is formed by mounting this process cartridge thereon, it will be appreciated that the present invention is applicable to an image forming apparatus in which the photosensitive drum 7 or the developing sleeve 10*d* is mounted directly on the main device, but not as a cartridge.

Further, while in the previous embodiment a laser beam printer was exemplified as the image forming apparatus, it will be understood that the present invention is not limited thereto, but also applicable to other image forming apparatuses such as an electrophotographic copying machine, a facsimile apparatus, and a word processor.

In this embodiment, owing to the provision of an indicator having leuco base applied thereto, leuco base will be colored with the degradation of components under the service environment with ozone arising from the charging means or nitrogen oxides in the atmosphere. Accordingly, the life span of components can be readily discriminated under the service environment based on the degree of coloration on the indicator, and therefore the recyclability of components can be easily discriminated in recycling the components.

As described above, with the present invention, it is possible to provide a process cartridge with an information indication having more information and an image forming apparatus. Further, with the present invention, the life span can be discriminated in accordance with the service environment.

What is claimed is:

1. A process cartridge mountable on a main body of an image forming apparatus, said process cartridge comprising:

a frame having a gripping portion;

an image bearing member;

process means for acting on said image bearing member; and a bar code provided on an outer surface of said frame at a position away from the gripping portion and facing upward when said process cartridge is mounted on the main body.

2. A process cartridge according to claim 1, wherein a transparent seal is pasted on a surface of said bar code.

3. A process cartridge according to claim 1, wherein said bar code has information of any one or all of a place of production, a producer, a production time and a lot number.

4. A process cartridge according to claim 1, wherein said bar code has information pertaining to the number of reproduction operations that the process cartridge is designed to achieve.

5. A process cartridge according to claim 1, wherein said bar code has information pertaining to the type of process cartridge.

6. A process cartridge according to claim 1, wherein said bar code is made by application of a leuco base.

7. A process cartridge according to claim 1, wherein said process cartridge has charging means, developing means or cleaning means as said process means, and an electrophotographic photosensitive body as said image bearing member, which are integrated as a cartridge to be detachable from the image forming apparatus.

8. A process cartridge according to claim 1, wherein said process cartridge has at least one of charging means, developing means and cleaning means as said process means, and an electrophotographic photosensitive body as said image bearing member, which are integrated as a cartridge to be detachable from the image forming apparatus.

9. A process cartridge according to claim 1, wherein said process cartridge has at least developing means as said process means and an electrophotographic photosensitive body as said image bearing member, which are integrated as a cartridge to be detachable from the image forming apparatus.

10. An image forming apparatus for forming an image on a recording medium, and having a main body and a process cartridge mountable thereon, said image forming apparatus comprising:

(a) mounting means capable of mounting a process cartridge, having a frame with a gripping portion, an image bearing member, process means for acting on said image bearing member, and a bar code provided on an outer surface of said frame at a position away from the gripping portion and facing upward when the process cartridge is mounted on the main body; and (b) conveying means for conveying the recording medium.

11. An image forming apparatus according to claim 10, wherein said apparatus is an electrophotographic copying machine.

12. An image forming apparatus according to claim 10, wherein said apparatus is a laser beam printer.

13. An image forming apparatus according to claim 10, wherein said apparatus is an LED printer.

14. An image forming apparatus according to claim 10, wherein said apparatus is a facsimile apparatus.

15. A process cartridge mountable on a main body of an image forming apparatus, said process cartridge comprising:

a frame having a gripping portion;

an image bearing member;

process means for acting on said image bearing member; and an indicator with a leuco base provided on an outer surface of said frame at a position remote from the gripping portion and facing upward when said process cartridge is mounted on the main body.

16. A process cartridge according to claim 15, wherein said indicator is made by affixing a label by application of leuco base.

17. A process cartridge according to claim 15, wherein said indicator is made by directly applying a leuco base to the component.

18. A process cartridge according to claim 15, wherein said indicator is made by applying a leuco base to a bar code providing information.

19. A process cartridge according to claim 15, wherein said indicator is coated.

20. A process cartridge according to claim 15, wherein said indicator has a film pasted thereon.

21. A process cartridge according to claim 15, wherein said process means comprises a charging means, and said indicator is provided in an air flow from said charging means.

22. A process cartridge according to claim 15, wherein said process cartridge has charging means, developing means or cleaning means as said process means, and an electrophotographic photosensitive body as said image bearing member, which are integrated as a cartridge to be detachable from the image forming apparatus.

23. A process cartridge according to claim 15, wherein said process cartridge has at least one of charging means, developing means and cleaning means as said process means, and an electrophotographic photosensitive body as said image bearing member, which are integrated as a cartridge to be detachable from the image forming apparatus.

24. A process cartridge according to claim 15, wherein said process cartridge has at least developing means as said process means and an electrophotographic photosensitive body as said image bearing member, which are integrated as a cartridge to be detachable from the image forming apparatus.

25. An image forming apparatus for forming an image on a recording medium, and having a main body and a process cartridge mountable thereon, said image forming apparatus comprising:

(a) mounting means capable of mounting a process cartridge having a frame with a gripping portion, an image bearing member, process means for acting on said image bearing member, and an indicator with a leuco base applied and provided on an outside surface of said frame at a position away from the gripping portion and facing upward when the process cartridge is mounted on the main body; and (b) conveying means for conveying the recording medium.

26. An image forming apparatus for use with a process cartridge, including a frame with a gripping portion for removably attaching the process cartridge to a main body of the image forming apparatus, for forming an image on a recording medium, said image forming apparatus comprising:

an image bearing member;

charging means for charging said image bearing member;

latent image forming means for forming a latent image on said image bearing member;

developing means for visualizing the latent image; and transferring means for transferring the visual image to the recording medium, wherein an indicator with a leuco base applied is provided at a predetermined site on an outer surface of the frame of the process cartridge, the predetermined site being away from the gripping portion and facing upward when the process cartridge is mounted on the main body.

27. An image forming apparatus according to claim 25, wherein said apparatus is an electrophotographic copying machine.

28. An image forming apparatus according to claim 26, wherein said apparatus is an electrophotographic copying machine.

29. An image forming apparatus according to claim 25, wherein said image forming apparatus is a laser beam printer.

30. An image forming apparatus according to claim 26, wherein said image forming apparatus is a laser beam printer.

31. An image forming apparatus according to claim 25, wherein said image forming apparatus is a facsimile apparatus.

32. An image forming apparatus according to claim 26, wherein said image forming apparatus is a facsimile apparatus.

33. A component for use in an image forming apparatus having a main body, characterized in that said component comprises a frame having a gripping portion which is removably attached to the image forming apparatus and an indicator which has a leuco base is provided on an outer surface of said frame of said component at a position away from the gripping portion and facing upward when said component is mounted on the main body.

34. Components according to claim 33, wherein said components are a photosensitive drum, charging means, developing means or cleaning means.

* * * * *

UNITED STATES PATENT AND TRADEMARK OFFICE

CERTIFICATE OF CORRECTION

PATENT NO. : 5,596,388

DATED : January 21, 1997

INVENTOR(S) : MASAHARU OHKUBO, ET AL.

It is certified that error appears in the above-indentified patent and that said Letters Patent is hereby corrected as shown below:

ON THE COVER PAGE:

Under item [56], "U.S. PATENT DOCUMENTS":

"5,235,384 10/1993 Oka et al." should read --5,235,384 8/1993 Oka et al.--

COLUMN 1:

Line 40, "causes a trouble." should read --cause trouble.--.

COLUMN 5:

Line 13, "itself 13." should read --13 itself.--.

COLUMN 6:

Line 54, "service men." should read --servicemen.--.

COLUMN 7:

Line 16, "10" should be deleted.

UNITED STATES PATENT AND TRADEMARK OFFICE

CERTIFICATE OF CORRECTION

PATENT NO. : 5,596,388

DATED : January 21, 1997

INVENTOR(S) : MASAHARU OHKUBO, ET AL.

It is certified that error appears in the above-indentified patent and that said Letters Patent is hereby corrected as shown below:

COLUMN 9:

Line 34, "precise" should read --precise steps--.

COLUMN 14:

Line 5, "leuco" should read --a leuco--.

Signed and Sealed this

Fifteenth Day of July, 1997

Bruce Lehman

*Attest:*

BRUCE LEHMAN

*Attesting Officer*

*Commissioner of Patents and Trademarks*